US005754388A

United States Patent [19]

Schmidt

[11] Patent Number: 5,754,388

[45] Date of Patent: May 19, 1998

[54] ELECTRICAL CHARGE DISSIPATION DEVICE

[76] Inventor: Ernest A. Schmidt, R.R. 1, Box 145 B3, Williston, N. Dak. 58801

[21] Appl. No.: 664,777

[22] Filed: Jun. 14, 1996

[51] Int. Cl.[6] ..... H05F 3/00

[52] U.S. Cl. ..... 361/215; 361/220

[58] Field of Search ..... 361/212, 215, 361/220, 222, 226

[56] References Cited

U.S. PATENT DOCUMENTS

| | | | |
|---|---|---|---|
| 3,629,656 | 12/1971 | Willig | 361/215 |
| 3,982,157 | 9/1976 | Azuma et al. | 361/215 |
| 4,215,384 | 7/1980 | Elson | 361/215 |
| 4,610,176 | 9/1986 | Schmidt et al. | 74/108 |

*Primary Examiner*—Jeffrey A. Gaffin
*Assistant Examiner*—Sally C. Medley
*Attorney, Agent, or Firm*—Timothy J. Martin; Michael R. Henson

[57] ABSTRACT

An electrical charge dissipation device is interposed between two sections of a fluid flow line and is operative to dissipate electrical charges present therein in order to reduce corrosion. The charge dissipation device comprises an elongated tubular portion having a central longitudinal axis and including a surrounding sidewall forming an interior passage therefor. Opposite first and second ends are adapted to interconnect respectively with the two sections whereby the tubular portion is interposed therebetween such that fluid flows through the interior passageway. A charge collector is disposed in the interior passageway in electrical isolation from each of the two sections and includes a plurality of longitudinally spaced apart conductors organized in a selected array. These conductors operate to conduct electrical charges contained in the fluid exteriorly of the tubular portion whereby they may be dissipated to an electrical ground. Preferably, the charge collector is formed by a plurality of rigid conductors which are longitudinally and angularly spaced apart within the interior passageway.

22 Claims, 3 Drawing Sheets

ELECTRICAL CHARGE DISSIPATION DEVICE

FIELD OF THE INVENTION

The present invention broadly relates to electrical conductors adapted for use in dissipating electrical charges that are present in a flowing fluid. The present invention is particularly directed to an electrical charge dissipation device that is adapted to be interposed between two sections of a fluid flow line and which is operative to dissipate electrical charges present in a fluid flowing therethrough so as to reduce corrosion, for example, in a metal pipeline system that transports petroleum products.

BACKGROUND OF THE INVENTION

Metal pipelines have long been employed in the oil and gas industry for the purpose of providing a conduit for the flow of certain fluids, such as oil, gasoline and other petroleum related bi-products. Metal pipelines are also found in the flow lines of many vehicles, such as truck fuel lines, water lines, etc. Inherent in these types of systems is the accumulation of electrical charges as the fluids flow through the metal pipeline. This buildup of electrical charge causes arching to occur between the fluid and the sidewalls of the conductive pipes.

The existence of these moving electrical charges accelerates corrosion of the metal pipeline which can greatly diminish its useful life. Another problem associated with electrolytic reactions in the proximity of a petroleum product, as well as other charged fluids, like water, is that of combustion of the fluid or vapors therefrom. This danger of fires or explosions and the concomitant damage which they create cannot be ignored.

There are several reasons why the efficacy of a metal pipeline, particularly one which accommodates the flow of petroleum products, should be maintained. First, corrosion of the pipeline and the eventual seepage of fluid therefrom can cause significant environmental damage. Further, a high capital investment is typically associated with transporting petroleum products through a flow line system and corrosion of the flow line must be prevented to avoid additional preparation costs.

At least one approach which has been employed in the past to alleviate the corrosion or deterioration of metal pipelines occasioned by these electrolytic reactions is known as the cathodic method. The goal in the cathodic method is to neutralize the electrical charges which are built up in the pipeline as fluids flow so that arching is reduced. To this end, the electrical potential between the fluid and the sidewalls of the pipes is measured. This potential is typically in the range of 30 milliamps. Then, the ground of the metal piping is matched to this measured electrical potential so that no arcing occurs. This procedure, however, is not entirely effective due to the unpredictability of the electrical currents which reside in this system. Not surprisingly, these electrical currents can vary widely depending upon their particular location within the pipeline system, turbulence of the fluid through the system, and existing environmental conditions. Thus, while the cathodic method may be useful in reducing some corrosion, the unreliability resulting from these variables, among others, makes other practical solutions to the corrosion problem more desirous to those in the oil and gas industry.

Given the inherent problems associated with metal pipeline systems as stated above, and the inability of others to appropriately address these problems, a need exists to improve existing metal pipeline systems so that corrosion resulting from the presence of electrical charges is effectively reduced. Accordingly, it would be advantageous to have an electrical charge dissipation device which is operative to dissipate these electrical charges so that the structural integrity of the metal pipeline is maintained. It would also be advantageous if such an electrical charge dissipation device could work reliably with a variety of flowing fluids and under a variety of encountered conditions. The present invention is directed to such an electrical charge dissipation device which meets these needs, among others.

SUMMARY OF INVENTION

It is an object of the present invention to provide a new and useful electrical charge dissipation device for dissipating electrical charges present in a flowing fluid.

Another object of the present invention is to provide an electrical charge dissipation device which is adapted to be interposed between two sections of a fluid flow line and which operates to dissipate electrical charges present in a fluid flowing therethrough.

A further object of the present invention is to provide an electrical charge dissipation device for reducing the occurrence of corrosion of a flow line, and particularly a flow line which conveys petroleum related products, such as an oil pipeline or the flow line of a vehicle, so as to prolong the structural integrity of the flow line.

Yet another object of the present invention is to provide an electrical charge dissipation device which is relatively easy to manufacture and which is adapted to retrofit into an existing flow line for the purpose of dissipating electrical charges present in a fluid flowing therethrough.

Still a further object of the present invention is to provide an electrical charge dissipation device which performs reliably under a variety of ambient conditions.

Still a further object of the present invention is to provide a new and useful electrical charge dissipation device which has a long lifetime of use and which requires little monitoring and maintenance.

To accomplish these objectives, then, an electrical charge dissipation device is provided which is adapted to be interposed between two sections of a fluid flow line and operates to dissipate electrical charges present in a fluid flowing therethrough to reduce corrosion of the flow line. The electrical charge dissipation device of the present invention broadly comprises an elongated tubular portion through which fluid flows and a charge collector which operates to conduct electrical charges contained in the fluid exteriorly of the tubular portion whereby these charges may be dissipated to an electrical ground.

The tubular portion includes a surrounding sidewall forming an interior passageway therefore and opposite first and second ends which are adapted to interconnect, respectively, with the two sections of the fluid flow line, so that the tubular portion is interposed between these sections fluid flows through the interior passageway. This tubular portion may be formed as an annular member, and preferably a cylindrical shell, and includes a flange formed on each of the first and second ends. Each of these flanges is adapted to mount to a cooperative flange structure formed on an associated one of the two sections. Where the tubular portion and its surrounding sidewall are formed of a conductive material, insulation gaskets are provided and are associated with each flange to electrically insulate the flange from its associated one of the two sections of the flow line.

It is preferred that the tubular portion and its sidewall, in fact, be formed of a conductive material to optimize conduction of electrical charges. Of course, a non-conductive tubular portion may also be employed with the present invention.

The charge collector is disposed in the interior passageway in electrical isolation from each of the two sections of the flow line, and this charge collector may be formed by a plurality of interconnected conductors. It is preferred that these conductors are longitudinally spaced apart along the tubular portion and organized in a selected array within the interior passageway. These conductors may also extend within the interior passageway transversely to the central longitudinal axis of the tubular portion and, preferably, they are formed as rigid rods which intersect the surrounding sidewall at two discrete locations therealong.

In one desired configuration for the array of conductors, these conductors are angularly spaced apart relative to one another within the interior passageway and pass through the central longitudinal axis. To create turbulence and generate optimum collection results, these conductors are spaced apart equiangularly relative to one another and pass through the central longitudinal axis.

A grounding wire is employed to electrically interconnect the electrical charge dissipation device to ground. Where the tubular portion is constructed of a conductive material, this grounding wire may be connected to any part of the electrical charge dissipation device. However, were the tubular portion and its sidewall are constructed of a nonconductive material, it is important that the grounding wire electrically interconnect each of the plurality of conductors. A metering unit may also employed through which the grounding wire passes so that the amount of electrical charges which are dissipated to electrical ground can be monitored.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention is directed to an electrical charge dissipation device for use in prolonging the structural integrity of components in a fluid flow line by reducing the corrosive effects on these components which may be caused by the buildup of electrical charges present in the fluid. A recurring problem associated with flow lines, and particularly metal pipelines for use in conveying fluids such as petroleum, water and the like, is that fluid traveling through the pipeline causes accumulation of electric current within the system. This results in arcing between the fluid and the sidewalls of the pipeline and causes accelerated corrosion of the metal piping. As the metal pipeline deteriorates over time, the risk of fluid seepage increases. To combat this, the present invention is particularly directed to an electrical charge dissipation device adapted to be interposed between two sections of a fluid flow line and operative to dissipate electrical charges in a fluid flowing therethrough, thereby to reduce the corrosive effects on the flow line. Of course, it should be understood from the discussion which follows that the principles of the electrical charge dissipation device of the present invention also allow it to be used in conjunction with a vehicle's fuel lines of water lines to prevent arcing.

Figure 1:
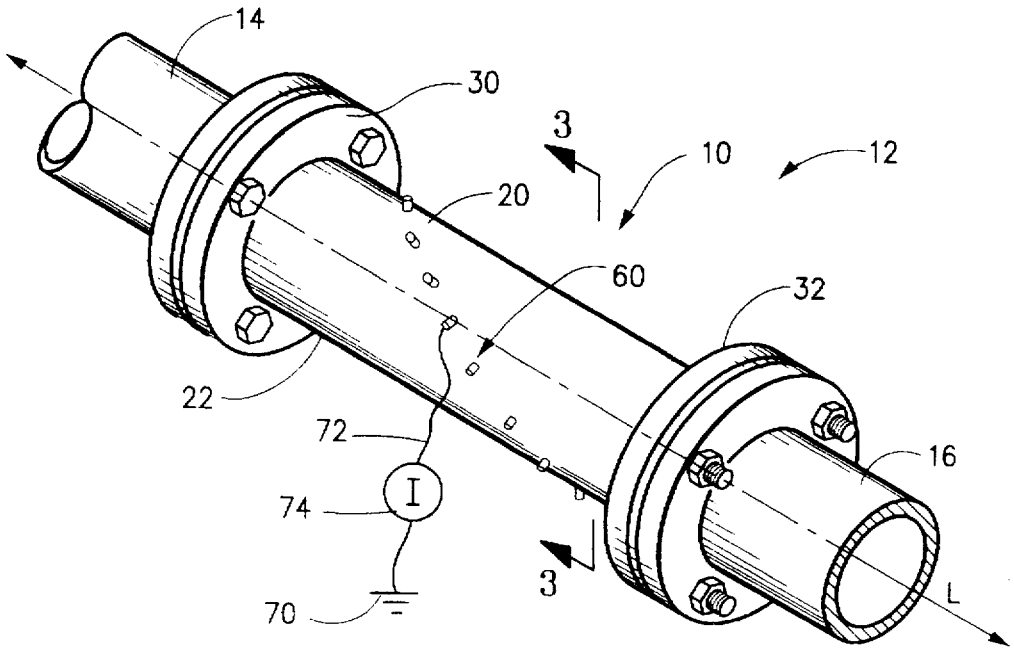
FIG. 1 is a perspective view in partial cross-section showing a first exemplary embodiment of the electrical charge dissipation device of the present invention, with the dissipation device interposed between two sections of a fluid flow line.
Figure 2:
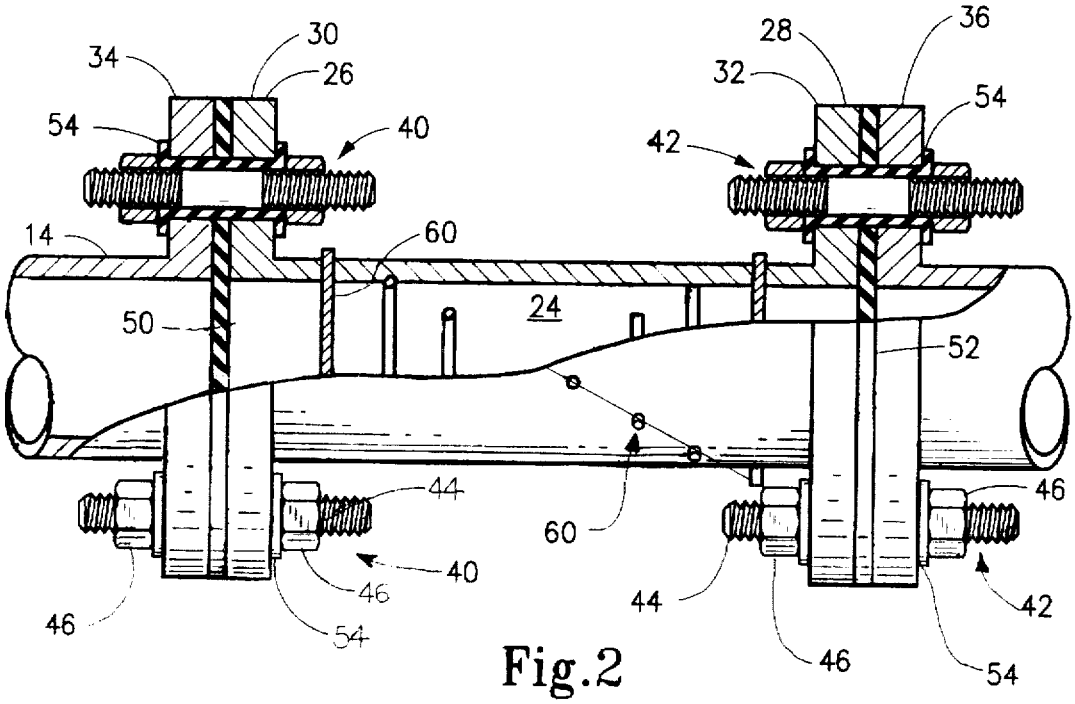
FIG. 2 is a side view in elevation and in partial cross-section showing the electrical charge dissipation device according to the first exemplary embodiment of the present invention.

A first embodiment of the present invention is generally introduced in FIGS. 1 and 2. Electrical charge dissipation device 10 is shown used in conjunction with a flow line 12 which accommodates the flow of fluid therethrough. More specifically, electrical charge dissipation device 10 is interposed between two sections 14 and 16 of flow line 12 so that it is in fluid communication with these two sections 14 and 16. Flow line 12 is a conventional metallic pipeline for use in transporting a variety of fluids having residual electrical charges, such as crude oil, petroleum, water and the like. As discussed above, electrical charge dissipation device 10 is operative to dissipate these electrical charges so as to reduce the corrosive effects on flow line 12.

Electrical charge dissipation device 10 comprises an elongated tubular portion 20 having a central longitudinal axis "L". Tubular portion 20 also includes a surrounding sidewall 22 which forms an interior passageway 24 for tubular portion 20. Opposite first and second ends 26 and 28 of tubular portion 20 are adapted to, respectively, interconnect with an associated one of sections 14 and 16 so that tubular portion 20 is interposed therebetween and fluid is allowed to flow through interior passageway 24.

To this end, a pair of radial flanges 30 and 32 are provided and each of these flanges 30, 32 is adapted to mount to a cooperative flange structure formed on an associated one of sections 14 and 16. Accordingly, flange 30 which is associated with first end 26 is fastened via mounting fasteners 40 to a flange structure 34 associated with section 14. Similarly, radial flange 32 associated with second end 28 is fastened via mounting fasteners 42 to flange structure 36 associated with section 16. Each of mounting fasteners 40 and 42 includes a bolt 44 and a pair of nuts 46 which are sized and adapted to threadedly engage bolt 44 thereby to secure the flanged sections together and retain tubular portion 20 in a compressed state between sections 14 and 16 of flow line 12. Of course, while tubular portion 20 is shown in the figures herein to be formed as a cylindrical shell with radial flanges disposed on its respective ends, it should be appreciated by one of ordinary skill in this field that a variety of cross-sectional configurations can be used in conjunction with a conventional flow line 12, with the important consideration being that tubular portion is adapted to sealably mount between sections of the pipeline.

The electrical charge dissipation device 10 of the present invention also includes a charge collector 60 which is disposed in the interior passageway 24 in electrical isolation from each of sections 14 and 16. This charge collector 60 is operative to conduct electrical charges contained in the flowing fluid and to direct these charges exteriorly of tubular portion 20 so that they may be dissipated to an electrical ground. Charge collector 60, which will be discussed in greater detail below with reference to FIGS. 3 and 4, includes a plurality of conductors 61–68 which are connected to an electrical ground 70 via a grounding wire 72 or other appropriate means so that electrical charges conducted by charge collector 60 may be diverted to the electrical ground 70. Where the electric charge dissipation device is used in conjunction with the fuel of water lines, etc. of a vehicle, such as truck, then grounding wire 72 would be connected to the truck's chassis.

A metering unit 74, shown in FIG. 1 to be a conventional ammeter, may also be employed so that a quantification for the amount of electrical charges which are dissipated by the electrical charge dissipation device 10 may be ascertained. Metering unit 74, therefore, may be used to monitor the efficacy of electrical charge dissipation device 10.

In this first exemplary embodiment for the electrical charge dissipation device 10 of the present invention, it is preferred that tubular portion 20 be constructed of a conductive material. It is believed that electrical charge dissipation device 10 operates best with this type of construction because it maximizes the potential for electrical charge collection while fluid is flowing therethrough. With the use of a conducting tube portion 20, it is necessary to electrically insulate the electrical charge dissipation device 10 from sections 14 and 16 of flow line 12 so that electrical charges are prevented from traveling to sections 14 and 16 via sidewall 22. Insulation gaskets 50 and 52 are, therefore, interposed in a compressed state between their respective pairs of radial flanges formed on tubular portion 20 and sections 14 and 16. Of course, it is also necessary to insulate mounting fasteners 40 and 42 from sections 14 and 16. Therefore, an insulative sleeve washer 54 is associated with each of mounting fastener 40 and 42 so that these mounting fasteners do not act as a conduit for electricity between tubular portion 20 and sections 14 and 16 of flow line 12.

The construction for charge collector 60 is best explained with reference now to FIGS. 3 and 4. As discussed previously, charge collector 60 is formed by a plurality of conductors 61–68 which are electrically interconnected to one another. It is preferred that conductors 61–68 be formed as rigid copper rods or other conductive material which are spaced apart longitudinally along tubular portion 20, as best illustrated in FIGS. 1 and 2, and which are organized in a selected array within interior passageway 24. Of course, it should be appreciated by the ordinarily skilled artisan that charge collector 60 could also take on a variety of configurations and types other than that shown in the figures herein. For example, charge collector 60 could be formed simply as a single conducting rod which passes through interior passageway 24 or as a plurality of interconnected rods which are not spaced apart longitudinally along tubular portion 20.

Where longitudinal spacing of conductors 61–68 is desired, it is preferred that these conductors 61–68 extend within interior passageway 24 transversely to central longitudinal axis "L" to maximize the surface areas of contact with the electrical charges present in the fluid. In addition, it is desirous that conductors 61–68 are angularly spaced apart relative to one another within interior passageway 24 and pass diametrically through the central longitudinal axis "L" to intersect surrounding sidewall 22 at two discrete locations therealong.

Figure 3:
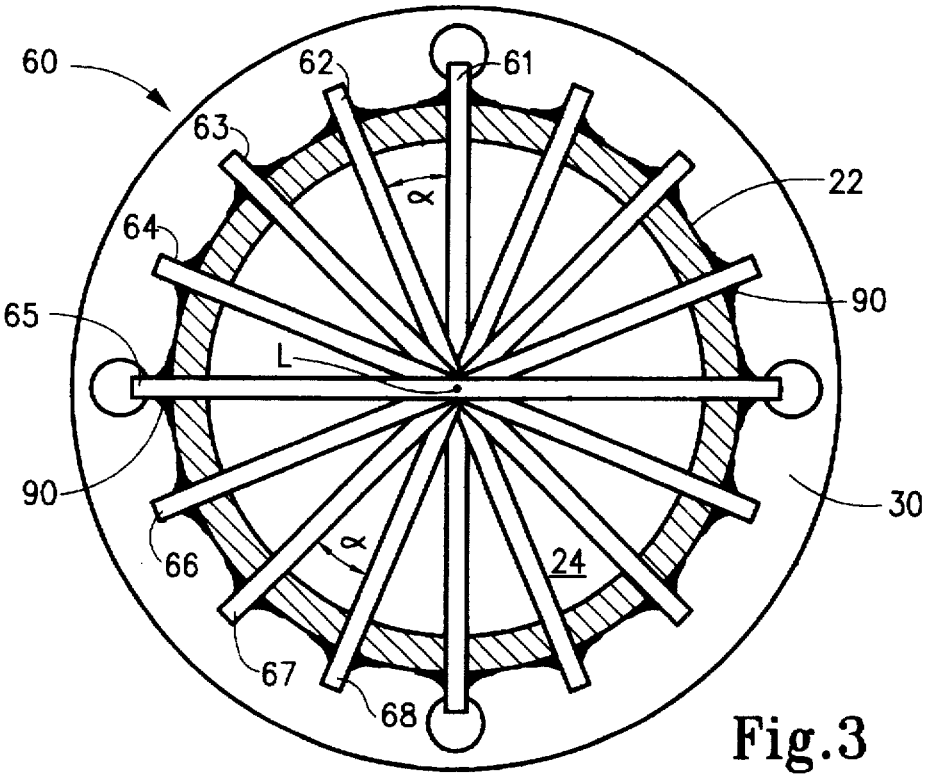
FIG. 3 is a side view in cross-section about lines 3—3 in FIG. 1 and showing one possible construction for the charge collector according to the first exemplary embodiment of the present invention.
Figure 4:
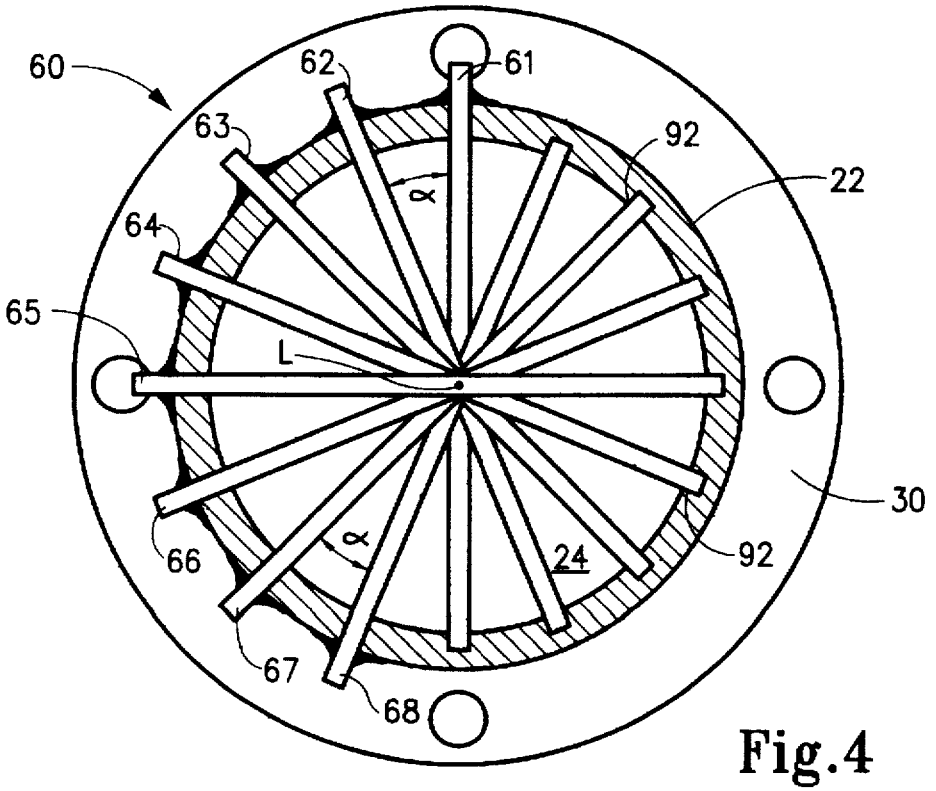
FIG. 4 is a side view in cross-section showing an alternative construction for the charge collector according to the first exemplary embodiment of the present invention.

To increase turbulence as the fluid flows through electrical charge dissipation device 10, and thus optimize collection of the electrical charges present in the fluid, conductors 61–68 are equiangularly spaced apart relative to one another and pass through central longitudinal axis "L". As such, each of conductors 61–68 is spaced apart from adjacent ones of these conductors by a common angle "a". Of course, this angle "a" varies depending on the number of conductors which are used, with one of the considerations for the particular number chosen being that one does not want to substantially impede the flow of fluid through flow line 12. While charge collector 60 is shown in the figures to be organized as a helical array within tubular portion 20, other types of arrays and links for conductors 61–68 are certainly contemplated.

Where conductors 61–68 extend diametrically through sidewall 22, they may each be mounted to this sidewall 22 by a weldment 90, as shown in FIG. 3, or by another appropriate means. A weldment, however, is believed to best maximize electrical interconnection between the array of conductors 61–68. Another possible mounting approach, as illustrated in FIG. 4, is to have one end of each of conductors 61–68 matably received in an associated socket 92 formed within sidewall 22. Although not necessary, the other ends of these conductors 61–68 are shown to protrude outside of sidewall 22 to facilitate grounding thereof.

Figure 5:
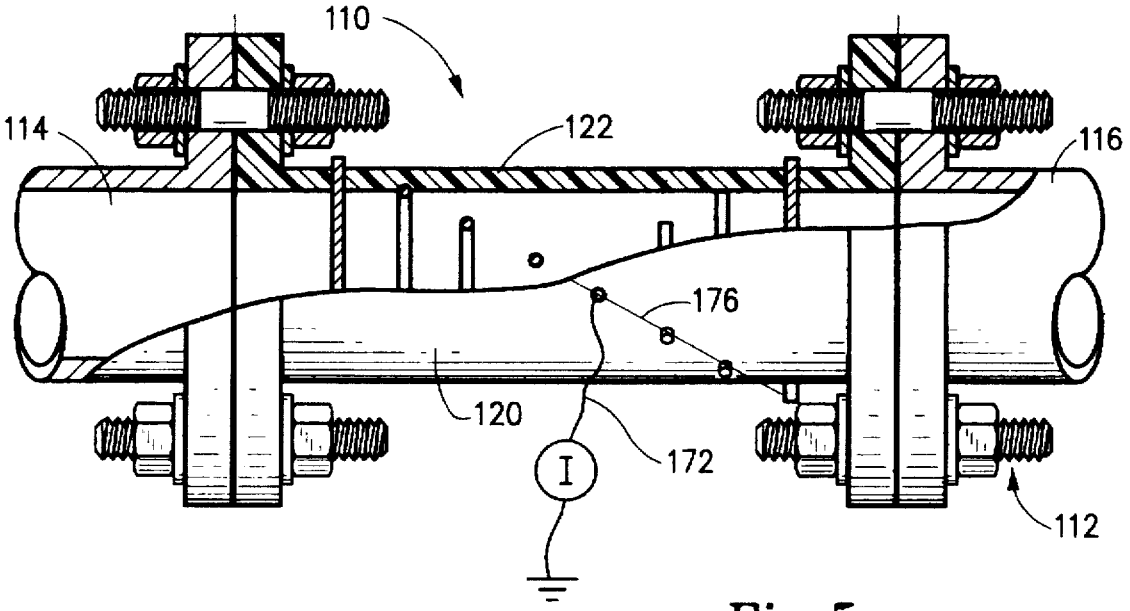
FIG. 5 is a side view in elevation and partial cross-section showing an electrical charge dissipation device according to the second exemplary embodiment of the present invention.

A second exemplary embodiment of the present invention is shown in FIG. 5 wherein it may be seen that electrical charge dissipation device 110 is constructed similarly to that shown in FIGS. 1 and 2 with the exception that, here, tubular portion 120 and sidewall 122 are constructed of a nonconductive material so that gaskets, washers and other insulation elements are not needed to effectively insulate tubular portion 122 from sections 114 and 116 of flow line 112. With this construction of electrical charge dissipation device 110 it is, of course, important to electrically interconnect conductors 161–168 of charge collector 160 via a wire or other appropriate device so that the electrical charges collected as fluid flows through flow line 112 may be efficiently grounded through a grounding wire 172. In other respects, however, this second exemplary embodiment of the electrical charge dissipating device 110 of the present invention is identical to that described above in reference to the first exemplary embodiment of the present invention.

Figure 6:
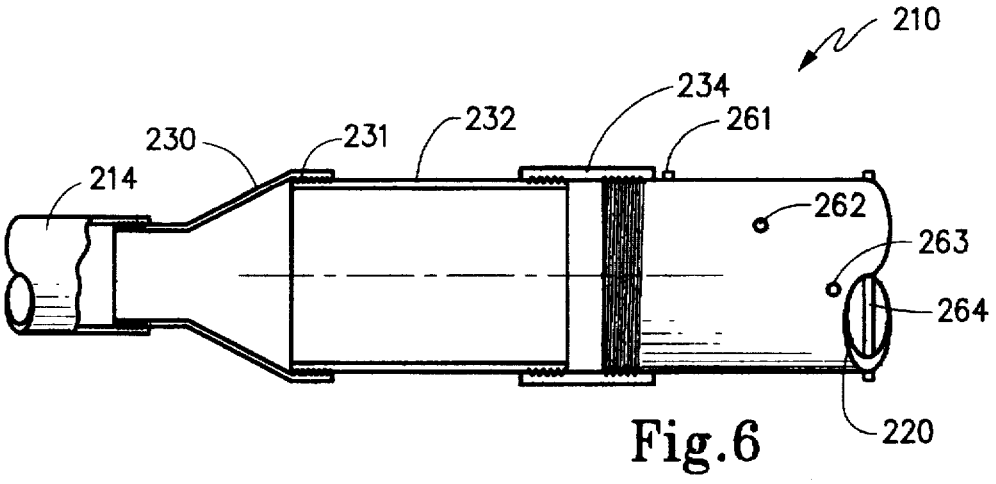
FIG. 6 is a side view in elevation and in partial cross-section showing an electrical charge dissipation device according to a third exemplary embodiment of the present invention.

Turning to FIG. 6, a third exemplary embodiment of the present invention is shown. Here, charge dissipation device 210 is constructed substantially identical to electrical charge dissipation device 10, described above. Thus, tubular portion 220 of charge dissipation device 210 is formed of a conductive material and supports a plurality of conductor rods 261–264 arranged in the interior thereof. Here, however, it is desired that the diameter of electrical charge dissipation device 210 be substantially larger than that of the flow line, such as is shown with respect to flow line section 214, so that the flow velocity of fluid flowing through electrical charge dissipation device 210 is slower relative to the flow line. In order to accommodate the larger dimension, a reducing connector 230 is threadably received on one of section 214. Connector 230 is typically constructed of a metal material and operates to change the diameter of the flow line to that of the enlarged diameter of electrical charge dissipation device 210. An insulating section 232 is threadably received in the enlarged end 231 of connector 230 and has an opposite end threadably received in a union section 234. Electrical charge dissipation device 210 is then threadably received in union 234 opposite insulating section 232. Insulating section 232 is formed of any suitable insulating material, such as fiberglass, plastic, etc. Union section 234 is typically formed of a metallic material. Thus, insulating section 232 isolates the electrical charge dissipation device 210 from section 214. It should be understood that the opposite end (not shown) of electrical charge dissipation device 210 is interconnected to a section of the flow line utilizing a union, an insulating section and a reducing connector identical, respectively, to union 234, insulating section 232, and connector 230.

With the foregoing description in mind with reference to the first and second exemplary embodiments of the present invention, then, it may be appreciated that in operation the electrical charge dissipation device is adapted to be interposed between two sections of a fluid flow line and operates to dissipate electrical charges present in a fluid flowing therethrough, thereby to reduce corrosion and deterioration of the flow line. As is common in many flow lines in which a charged fluid exists, such as metal pipelines for conveying petroleum products and the like, it is inherent that arcing occurs between the flowing fluid and the metallic sidewalls of the piping. In an effort to alleviate this occurrence, then, the present invention incorporates a charge collector which may be formed as a plurality of interconnected copper rods organized in a selected array to create turbulence and attract these electrical charges as they flow and to ultimately dissipate these electrical charges to an electrical ground source. It is believed that the construction for the electrical charge dissipation device of the present invention operates more efficiently than approaches which have been taken in the past to alleviate corrosion in pipelines resulting from the presence of these electrical charges.

Accordingly, the present invention has been described with some degree of particularly directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. An electrical charge dissipation device adapted to be interposed between two sections of a fluid flow line and operative to dissipate electrical charges present in a fluid flowing therethrough to reduce corrosion of said flow line, comprising:

(a) an elongated tubular portion including a surrounding sidewall forming an interior passageway therefor and opposite first and second ends adapted to interconnect, respectively, with the two sections whereby said tubular portion is interposed therebetween such that fluid flows through the interior passageway; and (b) a charge collector disposed in the interior passageway in electrical isolation from each of the two sections of the flow line, said charge collector formed by a plurality of electrically interconnected conductors which are each adapted to connect to an electrical ground, said charge collector operative to conduct electrical charges contained in the fluid exteriorly of said tubular portion whereby said charges may be dissipated to the electrical ground.

2. An electrical charge dissipation device according to claim 1 wherein said surrounding sidewall is constructed from a conductive material.

3. An electrical charge dissipation device according to claim 2 wherein said surrounding sidewall is grounded and said charge collector is electrically connected to said surrounding sidewall.

4. An electrical charge dissipation device according to claim 2 wherein said tubular portion is an annular member and includes a flange formed on each of said first and second ends, each said flange adapted to mount to a cooperative flange structure formed on an associated one of said two sections thereby to interconnect said tubular portion to said two sections, and including an insulation gasket associated with each said flange and operative to electrically insulate said flange from its associated one of said sections.

5. An electrical charge dissipation device according to claim 1 wherein said tubular portion is formed as a cylindrical shell.

6. An electrical charge dissipation device according to claim 5 wherein said tubular portion includes a radial flange formed on each of said first and second ends, each said flange adapted to mount to a cooperative flange structure formed on an associated one of said two sections thereby to interconnect said tubular portion to said two sections.

7. An electrical charge dissipation device according to claim 1 wherein said sidewall is constructed from a non-conductive material.

8. An electrical charge dissipation device adapted to be interposed between two sections of a fluid flow line and operative to dissipate electrical charges present in a fluid flowing therethrough to reduce corrosion of said flow line, comprising:

(a) an elongated tubular portion having a central longitudinal axis and including a surrounding sidewall forming an interior passageway therefor and opposite first and second ends adapted to interconnect, respectively, with the two sections whereby said tubular portion is interposed therebetween such that fluid flows through the interior passageway; and (b) a charge collector disposed in the interior passageway in electrical isolation from each of the two sections, said charge collector including a plurality of longitudinally spaced apart conductors organized in a selected array within the interior passageway, said conductors being electrically interconnected so that said charge collector is operative to conduct electrical charges contained in the fluid exteriorly of said tubular portion whereby said charges may be dissipated to an electrical ground.

9. An electrical charge dissipation device according to claim 8 wherein said conductors are angularly spaced apart relative to one another within the interior passageway.

10. An electrical charge dissipation device according to claim 9 wherein said conductors are equiangularly spaced apart relative to one another and pass through the central longitudinal axis.

11. An electrical charge dissipation device according to claim 10 wherein said conductors are formed as rigid rods which intersect said surrounding sidewall at two discrete locations therealong.

12. An electrical charge dissipation device according to claim 8 wherein each of said conductors extends within the interior passageway transversely to the central longitudinal axis.

13. An electrical charge dissipation device according to claim 12 wherein said conductors are formed as rigid rods which intersect said surrounding sidewall at two discrete locations therealong.

14. An electrical charge dissipation device according to claim 13 wherein each of said conductors passes through the central longitudinal axis.

15. An electrical charge dissipation device according to claim 8 wherein said surrounding sidewall is constructed of a non-conductive material.

16. An electrical charge dissipation device according to claim 15 wherein said conductors are formed as rigid rods which are electrically interconnected at their respective ends by a grounding wire.

17. An electrical charge dissipation device according to claim 16 wherein said grounding wire passes through a metering unit which is operative to indicate amount of said electrical charges which are dissipated to electrical ground.

18. An electrical charge dissipation device according to claim 8 wherein said sidewall is constructed of a conductive material.

19. An electrical charge dissipation device according to claim 18 wherein said charge collector is connected to said sidewall and said sidewall is grounded.

20. An electrical charge dissipation device according to claim 18 wherein said tubular portion is circular in cross-section and includes a radial flange formed on each of said first and second ends, each said flange adapted to mount to a cooperative flange structure formed on an associated one of said two sections thereby to interconnect said tubular portion to said two sections.

21. An electrical charge dissipation device according to claim 20 including an insulation gasket associated with each said flange and operative to electrically insulate said flange from its associated one of said two sections.

22. An electrical charge dissipation device adapted to be interposed between two sections of a fluid flow line and operative to dissipate electrical charges present in a fluid flowing therethrough to reduce corrosion of said flow line, comprising:

(a) an elongated tubular portion having a central longitudinal axis and including a surrounding sidewall forming an interior passageway therefor and opposite first and second ends adapted to interconnect, respectively, with the two sections whereby said tubular portion is interposed therebetween such that fluid flows through the interior passageway; and (b) a charge collector disposed in the interior passageway in electrical isolation from each of the two sections, said charge collector including a plurality of longitudinally spaced apart, and transversely extending, straight conductors organized in a spiraling array within the interior passageway, said conductors operative to conduct electrical charges contained in the fluid exteriorly of said tubular portion whereby said charges may be dissipated to an electrical ground.

* * * * *